United States Patent [19]

Lacoude et al.

[11] Patent Number: 4,594,115

[45] Date of Patent: Jun. 10, 1986

[54] PROCESS FOR THE MANUFACTURE OF RODS OR MACHINE WIRE OF MARTENSITIC STAINLESS STEEL AND THE PRODUCTS WHICH ARE PRODUCED

[75] Inventors: Michel Lacoude; Michel Lluansi, both of Albertville; Philippe Munier, Faverges, all of France

[73] Assignee: Ugine Aciers, Puteaux, France

[21] Appl. No.: 750,190

[22] Filed: Jul. 1, 1985

[30] Foreign Application Priority Data

Jul. 4, 1984 [FR] France ..... 84 11050

[51] Int. Cl.[4] ..... C21D 9/52

[52] U.S. Cl. ..... 148/12 B; 148/12 E; 148/37

[58] Field of Search ..... 148/12 B, 12 E, 37, 148/2

[56] References Cited

U.S. PATENT DOCUMENTS

| | | | |
|---|---|---|---|
| 2,337,185 | 12/1943 | Caugherty | 148/12 B |
| 2,795,519 | 6/1957 | Angel et al. | 148/12 E |
| 3,154,412 | 10/1964 | Kasak et al. | 148/12 E |
| 4,042,423 | 8/1977 | van den Sype et al. | 148/12 B |
| 4,161,415 | 7/1979 | van den Sype et al. | 148/12 B |
| 4,265,679 | 5/1981 | Ohashi et al. | 148/12 E |

*Primary Examiner*—Wayland Stallard

*Attorney, Agent, or Firm*—Dennison, Meserole, Pollack & Scheiner

[57] ABSTRACT

A process for the manufacture of martensitic stainless steel rods or machine wire, and the products thus obtained, by hot rolling, which steel comprises by % weight:

C=0.015 to 0.090
N=0.015 to 0.080 with C+N=0.05 to 0.120
Cr=9.0 to 14.0
Nb=≦0.1
V=≦0.1
S=≦0.35
Si=≦1.0
Mn=≦1.0
Ni=≦2.0
Mo=≦1.0
P=≦0.040
Cu=≦1.0
Fe and impurities=balance and having the following mechanical properties: R=900 to 1100 MPa; E 0.2=650 to 850 MPa; A≧10%; and resilience KCU≧40 J/cm$^2$, and wherein the preheating or the end of the hot rough preliminary processing preceding the final hot rolling brings the products to a temperature between 1000° C. and 1160°, and wherein the final hot rolling which is effected at a temperature below or equal to 1150° C. produces a section reduction "S/s" which is at least equal to 3, and which reduction is followed by homogenous cooling and when S≦0.08% the rods or machine wire have the following mechanical properties: R=900 to 1100 MPa; E 0.2=650 to 850 MPa; A=12 to 16%; resilience KCU=80 to 140 J/cm$^2$, and the rods or machine wire of the invention are particularly used for the manufacture of corrosion resistant mechanisms.

10 Claims, 3 Drawing Figures

PROCESS FOR THE MANUFACTURE OF RODS OR MACHINE WIRE OF MARTENSITIC STAINLESS STEEL AND THE PRODUCTS WHICH ARE PRODUCED

The process of the present invention concerns a method for the manufacture of stainless steel rods or machine wire.

STATE OF THE ART

Customary martensitic stainless steels with good mechanical strength correspond to the NF standard A 35-575: "Z12C13"; Z20C13"; and "Z30C13", all having 0.08 to 0.34% C and 11.5 to 14.0% Cr content. These are martensitic steels, in other words they have a predominately martensitic structure.

After hot rolling and cooling, they are hard and fragile, and a quenching treatment is applied to them, then a tempering to confer high mechanical strength on them, as in:

heating to 950 to 1050 C.;
oil quenching; and
tempering between 550 and 650 C.;
and the following typical features are obtained:
R=900 to 1100 MPa; E 0.2=650 to 850 MPa;
A=12 to 16%; and
resilience KCU=20 to 60 J/cm$^2$.

This resilience is of mediocre quality, which partially accounts for the toughness and it is not possible to improve it in the domain of stainless steels except by recourse to more costly steels such as "Z6CND 16-04" (NF standard A 35-581) and "Z6CNU 17-04-01" (NF standard A 35-574), which in quenched-tempered state give the characteristics (R, E, A) the same as the preceding, with an improved KCU resilience: 80 to 140 J/cm$^2$.

Attempts have been made to obtain rods of approximately 13% Cr having the same mechanical features as those of more costly "Z6CND 16-04" and "Z6CNU 17-04-01" stainless steels, by simplifying or by avoiding the quenching and tempering treatment. Attempts have been made to obtain martensitic rods of stainless steel of approximately 13% Cr which at the same time possess good mechanical strength, good ductility and, in a new feature, a good resilience, under economical manufacturing conditions.

SUMMARY OF THE INVENTION

The invention consists of selection of the composition and hot rolling conditions which is a surprising manner lead to the properties which are sought in a rough hot rolled state.

Proper composition and rolling conditions are both necessary in order to obtain these properties. Metallurgical tests allow qualitative indications of the effects of these conditions, effects which appear complex, and the tests indicate practical limits for the conditions of the process of the invention and the features of the products, obtained.

The stainless steels and semi-stainless steels of the invention have the following compositions, % by weight, the preferential ranges indicated to be taken separately or in any combination:

C=0.015 to 0.090% and preferably 0.030 to 0.060%
N=0.015 to 0.080% and preferably 0.020 to 0.050% with C+N=0.05 to 0.120% and preferably C+N=0.050 to 0.100%

Cr=9.0 to 14.0% and preferably 11.0 a 14.0% and more preferably 11.5 to 13.5%
Nb≦0.1%
V≦0.1%
S≦0.35 with 3 preferential ranges:
S≦0.03% optimum features;
S=0.03 a 0.08% only slightly modified mechanical features, improved suitability for machining; and
0.08≦S≦0.35%, lower resilience, improved suitability for machining.
Si≦1.0%=Mn≦1.0%−Ni≦2.0% and preferably ≦1.0%−Mo≦1.0%
P≦0.040%
Cu≦1.0%
other elements and Fe: balance.

The "other elements" are those used traditionally for manufacture in electric furnace steelworks using scrap iron, and their total is customarily below 0.5%. The residual Al content is specifically below 0.1%.

The adjustment of the total "C+N" content is an essential point of the invention: it allows the mechanical strength (R, R 0.2) of the product obtained to be raised and good resilience (KCU) to be preserved. An example will show the damaging influence of too high a "C+N" content on the resilience.

When the steel contains S, and especially when its S content is between 0.08 and 0.30%, the process of the invention provides hot rolled rods or of machine wire which still have very desirable mechanical properties. With improved suitability for machining, these products in fact have very good mechanical properties (R, E) with a proportionally weaker resilience as the S content is raised, but always greater than 40 J/cm$^2$.

Optional additions of Nb≦0.1% and V≦0.1% have a hardening effect which is translated essentially by an improvement of the breaking load "R" and particularly of the elastic limit of "E 0.2" of 0.2%.

An addition of nickel can be made, principally to improve the resilience, if the cost is not excessive. Such an addition tends to decrease the proportion of ferrite in the martensite/ferrite structure.

The rolling conditions required to obtain the mechanical properties of rod or machine wire according to the invention are the following: after optional hot rough preliminary processing of the product, which is or is not followed by cooling, the product must be brought to between 1050° C. and 1160° C. before being subjected to final hot rolling, this preselected temperature being obtained by either preheating or reheating, or by general preliminary processing conditions which bring the product to this temperature at the time of the arrival of the product at the final rolling. Final hot rolling of the product which has thus been brought to between 1050° and 1160° C. is then effected in practice at a temperature below or equal to 1050° C., as the product cools down 10° C. or more while this rolling is being started, and it must produce a cross-section reduction of "S/s" at least equal to 3, wherein "S" is the cross-section obtained during said rolling and "s" is the cross-section obtained at the end of said final hot rolling. Tests have shown that the final hot rolling should preferably be terminated between a temperature of 1050° and 950° C., of the product. Finally, the final hot rolling must be followed by a homogenous air cooling. Means to accelerate the cooling, such as air jets or mists e.g., water+air, can be used, provided that the cooling remains homogenous, in other words provided that the cooling speeds differ very little from one cross-section to another of the product. The preheating before the final hot rolling can also be lower than 1050° C., e.g. between 1000° C. and 1050° C., but the process, while stil applicable, becomes more difficult to use.

As indicated by the tests, the adjustment of the rolling temperature is important relative to the adjustment of the composition for control of the ferrite content, the dissolved (C+N) content and the grain size of the product, all particularly important factors relating directly to the very surprising mechanical properties of the rod or machine wire according to the invention wherein:

if: S≦0.08%, R=900 to 1100 MPa; E 0.2=650 to 850 MPa; A=12 to 16%; and KCU resilience=80 to 140 J/cm$^2$;

if: S is greater than 0.08% and lower than or equal to 0.35%, R=900 to 11000 MPa;

E 0.2=650 to 850; MPa A≦10%; KCU resilience ≦40 J/cm$^2$.

The rod or machine wire produced according to the invention are characterized by their mechanical properties and are recognizable by analysis, these mechanical features showing clearly in such an analysis. They are also characterized by a ferrite proportion of below 30% in the martensite and typically between 15 and 25%, and also by an average grain or phase diameter (martensite and ferrite) which is 65 μm to 11 μm which is equivalent to 5 to 10 ASTM (ASTM specification E 112). These structural characteristics are for a good part responsible for the mechanical properties.

The rods according to the invention are presented in the form of raw, i.e., untrimmed or rough hot rolled rods, or hot rolled an then trimmed rods, optionally with a surface finish, of diameter or thickness between 15 and 250 mm and preferably between 15 and 120 mm.

The machine wire of diameter between 5 to 35 mm according to the invention is generally produced in the form, e.g. an annulus or ring or coil, of a crown/rim.

Upon discharge from the final hot rolling, cooling is generally accomplished in crowns/rims or helical coils.

EXAMPLES

The results of four series of complementary tests and investigations taken together with the drawings will provide a better understanding of the invention and its various aspects.

EXAMPLE 1

A casting (A) was made in 250 mm squares, and was analyzed in terms of % by weight as:

C=0.038
N=0.029 therefore C+N=0.067
Cr=12.36
V=0.032
S=0.016
Si=0.27
Mn=0.42
Ni=0.28
Mo=0.07
P=0.019
Cu=0.11
Fe+impurities=balance The hot rough preliminary processing was carried out in the blooming-mill, as usual, at approximately 1200°-1250° C., transforming the 250 mm squares into squares of 148 mm.

The 148 mm squares were then preheated in an oven at various temperatures as indicated in the table, and then subjected to final hot rolling in successive passes until they reached the diameters shown in Table I and then were air cooled. According to measurements done by optical pyrometer, it was estimated that the rod temperature at the end of rolling was between 950° and 1000° C. in all cases.

TABLE I

| | | | CHARACTERISTICS OF ROLLED RODS | | | | | | |
|---|---|---|---|---|---|---|---|---|---|
| Rep. | ϕ Rolled Bars (mm) | Preheating Temperature (°C.) | R (MPa) | E 0.2 (MPa) | A % | Red. of area Z % | KCU (J/cm$^2$) | Average Grain Size (ASTM) | % Ferrite in the Martensite |
| A1 | 20 | 1120/1140 | 1085 | 790 | 16 | 64 | 116-122 | 8-9 | 19 |
| A2 | 35 | 1080/1100 | 1015 | 695 | 14 | 52 | 104-106 | Edge: 8-9<br>Core: 7-8 | 26 |
| A3 | 50 | 1160 | 1055 | 765 | 12 | 45 | 102-110 | Edge: 7-8<br>Core: 6-8 | 23 |
| A4 | 65 | 1080/1100 | 1035 | 685 | 14 | 53 | 118-132 | 5-7 | 22 |
| A5 | 80 | 1080/1100 | 1060 | 720 | 14 | 60 | 94-98 | Edge: 7-9<br>Core: 6-8 | 18-20 |
| A6 | 80 | 1240 | 1005 | 610 | 4 | 8 | 28-28 | Edge: 3-5<br>Mid. Radius: 1-3<br>Core: 2-4 | 22-26 |

These results show the excellent mechanical properties obtained for the preheated rods A1 to A5 which were preheated to between 1150° C. and 950° C. (rod temperature), with a minimum S/s cross section reduction in the case of the "A5" rods, which was then equal to:

$$(148)^2/\frac{\pi}{4} \times (80)^2 = 4.3$$

The maximum section reduction is that of the A1 ϕ20 mm bars, wherein S/s=69.

The case of the "A6" rods preheated to 1240° C. and thus hot rolled starting from 1220°-1230° clearly shows the negative effect of this relative overheating on the ductility (A%, Z%) and on the KCU resilience. These are especially the much larger grains at mid-radius and at the core than in the rods which are preheated and rolled under the conditions of the invention, which explains these poor results. In comparison with the "A5" rods, it is obvious that the elastic limit obtained with these preheating and hot rolling conditions is also lowered and that the break load also seems to be slightly effected.

EXAMPLE 2

Figure 1:
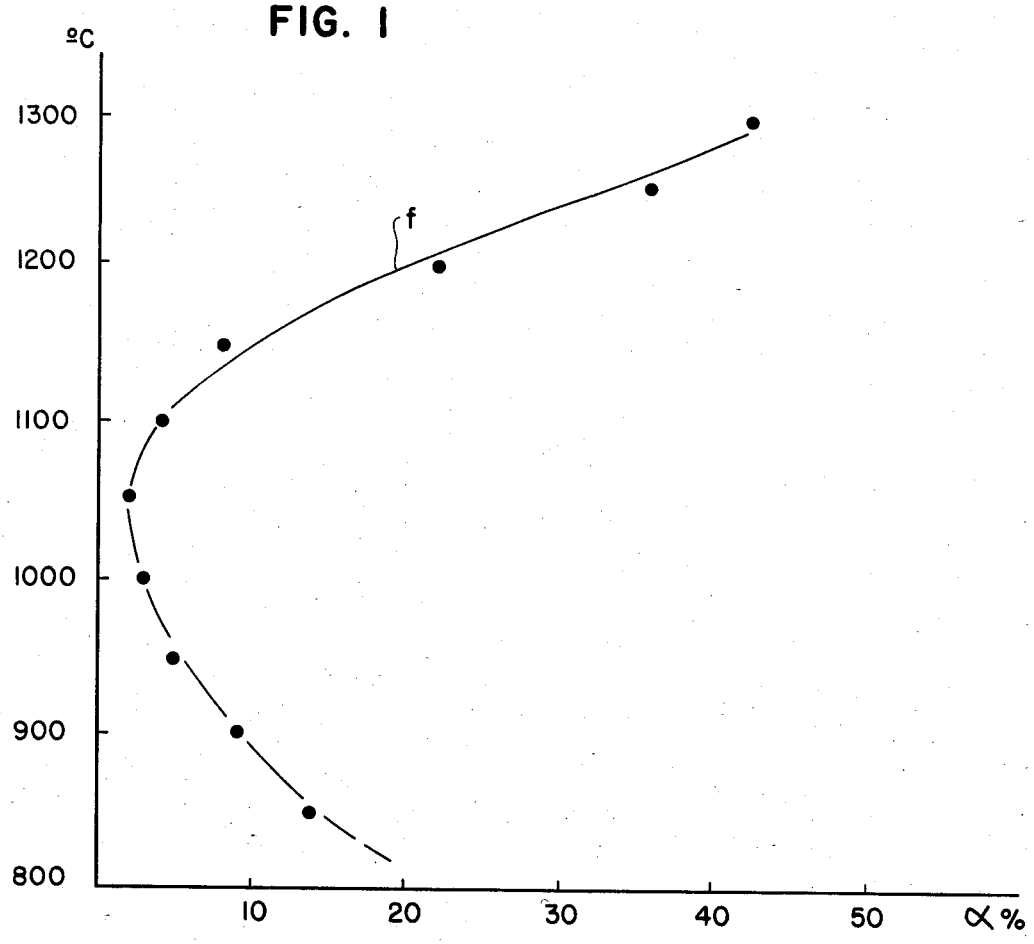
FIG. 1 shows the evolution of the ferrite portion as a function of the preheating temperature, in the case of the casting (A) of the first series of tests.

A large rod of the A casting was transformed by rolling and forging into plates of 20 mm thickness, of which samples were brought in 30 minutes at various reheating temperatures from 850° to 1300° C., then cooled rapidly by a water quenching. The "$\alpha$%" or proportion of ferrite in the martensite was determined for each sample micrographically. The results are shown in FIG. 1. The curve (f) which connects the dots or points requires the following comment: for this casting A and for the samples which are thus preheated and quenched, the $\alpha$% adapts by a minimum (2%) to the reheating temperature of 1050° C. The $\alpha\% < 10$ ferrite content is obtained for preheating temperatures between 950° and 1150° C. A qualitative indication is thus obtained: the adjustment of the preheating and rolling temperatures is certainly important for control of the ferrite content. The ferrite content must be minimized to obtain good resilience and good mechanical strength, and thus the preheating and rolling is restricted to a temperature interval dependent upon this effect in the actual dynamic conditions and other very important factors: e.g., dissolution and maintenance of the solution of C and of N in order to harden the matrix, and obtain a fine grain structure by preheating and recrystallization in the course of rolling.

EXAMPLE 3

A casting (B) was made and analyzed in terms of % by weight as:

C=0.050
N=0.038 therefore C+N=0.088
Cr=12.55
S=0.06
Si=0.34
Mn=0.45
Ni=0.19
Mo=0.05
P=0.019
Cu=0.11
Fe and impurities=balance.

The cast squares of 250×250 mm were transformed hot as in the prior Example and similar tests were carried out, starting with squares of 148 mm, with air cooling of the rods obtained. The rod temperature at the end of rolling was between 950° and 1000° C. The preheating temperatures and the mechanical properties of the rods which were obtained are shown in Table II below:

TABLE II

| | | Pre- | CHARACTERISTICS OF ROLLED RODS | | | | |
|---|---|---|---|---|---|---|---|
| Rep. | $\phi$ Rolled Bars (mm) | heat. Temp. (°C.) | R (MPa) | E 0.2 (MPa) | A % | Red. of area Z % | KCU (J/cm$^2$) |
| B1 | 20 | 1100 | 1080 | 770 | 16 | 63 | 134 |
| B2 | 25 | 1110 | 1035 | 695 | 18 | 63 | 134 |
| B3 | 33 | 1100 | 1020 | 685 | 17 | 63 | 125 |
| B4 | 35 | 1180 | 995 | 615 | 13 | 51 | 60 |

These tests, corresponding to a higher (C+N) content than in Example 1, are a confirmation of the tests of Example 1. The 1180° C. preheating temperature for "B4" greatly affects the KCU resilience and more slightly, but clearly: the ductility (A% and Z%), and especially E 0.2. The closeness of the "B4" and "A6" results clearly show the progressive effect of the "overheating" in relation to the preheating temperature limit of 1160° C. (rods "A3") according to the invention.

COMPARISON OF EXAMPLES 1 AND 3

Figure 2:
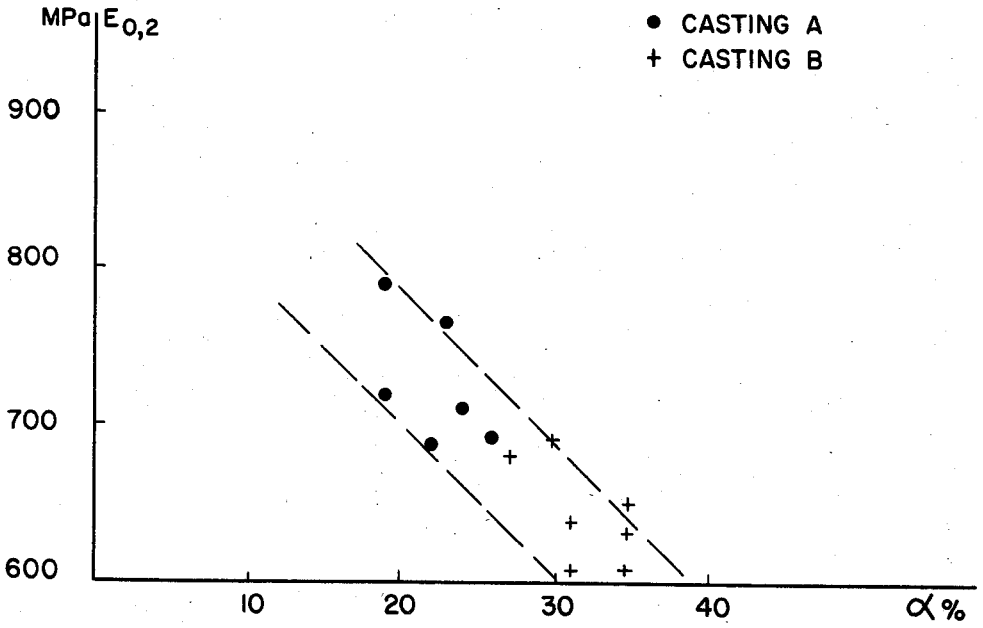
FIG. 2 shows the casting limits E 0.2 as a function of the percentage of ferrite for the rods obtained from the first and third series of tests.

The elastic limits of the rods of two castings (A) and (B) (first and third examples) are shown on the graph of FIG. 2.

This graph shows that in the ferrite content $\alpha$% range of 18 to 35%, a 10% reduction of the $\alpha$% generally corresponds to an increase of approximately 100 MPa of E 0.2.

EXAMPLE IV

For purposes of comparison a steel (D) of higher (C+N) content than those of the invention was tested, showing analysis:

C=0.105
N=0.039, therefore C+N=0.144
Cr=12.19
Nb=0.073
V=0.073
S=0.015
Si=0.41
Mn=0.92
Ni=0.18
Mo=0.46
P=0.021
Al=0.02
Fe and impurities=balance This steel was rolled in rods $\phi$80 mm at 1100° C. with an "S/s" ratio of 4. The mechanical features obtained on these rods are: R=1210 MPa; E 0.2=1060 MPa; A=15% reduction of area; Z%=60; and KCU 5-10 J/cm$^2$.

A very weak resilience is thus obtained with high (C+N), and when (C+N) and even more so both (C+N) and S are increased, a risk of shrinkage or cracking of the rods is added to this very weak resilience.

Comments: Effect of (C+N)

Figure 3:
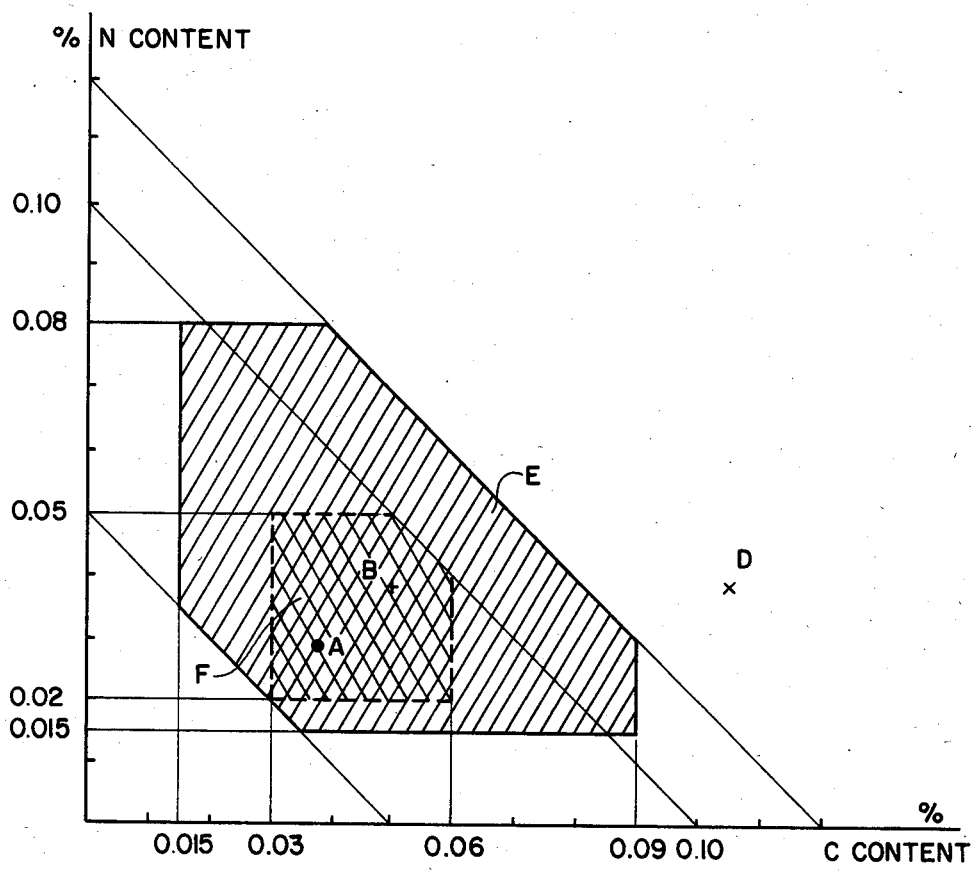
FIG. 3 shows the final (C%+N%) content ranges of the rods or machine wire of the invention.

FIG. 3 on the one hand shows the symbolic points (C%, N%) of the castings (A), (B) and (D), and on the other hand shows the range (E) of contents (C%, N%) according to the invention as well as the narrowest preferential range (F).

The hardening of the rods, translated by the increase of R and E 0.2, depends essentially upon the dissolved (C+N) content. Small additions of Nb$\leqq$0.1% and/or V$\leqq$0.1% also play a role in the hardening process. In the case of the rods (D), the good R and E 0.2 properties are linked to the high (C+N) content and the small additions of Nb and V, but the (C+N) content is beyond the scope of the invention and the resilience is very weak.

The series of tests of Examples 1 and 3 also show the influence of the preheating temperature and of final hot rolling temperature on the range of composition of the invention. By comparison with the traditional quenching treatment, which typically comprises a dissolution heating of between 950° and 1050° C., the effect of this preheating and this hot rolling according to the invention is to best dissolve (C and N) and to best retain them in solution. While the increase of C also slightly raises the quenchability, the increase of N can contribute to grain fineness in recrystallization in the course of rolling by virtue of the precipitation of small nitrides.

The metallurgical effects of C, N, C+N and preheating and rolling temperatures thus appear to be complex and "integrated", because to various degrees they influence the following:

the size of grain;

the ferrite proportion in the martensite; and the hardness of the matrix, which appears to play an important role in the qualitative determination of the surprising results of the invention. The adjustment of (C+N) is a particularly important factor.

The process is particularly adapted to the production of rods or machine wire using continuous hot rolling means.

The rods or machine wire of the invention are particularly used for the manufacture of corrosion-resistant mechanisms, which operate in contact with water, water vapor, wine or beer: such as shafts, pistons, cylinder liners, valves or bolts and nuts.

What is claimed is:

1. In a process for the manufacture of martensitic stainless steel rods or machine wire, wherein a steel is provided and is cast in the form of intermediate products, and the cast intermediate products are transformed by hot rolling, comprising an optional rough preliminary processing, an optional preheating and a final hot rolling to produce a final product, the improvement comprising steel of the following composition, % by weight:

C=0.015 to 0.090
N=0.015 to 0.080 with C+N=0.05 to 0.120
Cr=9.0 to 14.0
Nb=≦0.1
V=≦0.1
S=≦0.35
Si=≦1.0
Mn=≦1.0
Ni=≦2.0
Mo=≦1.0
P=≦0.040
Cu=≦1.0
Fe and impurities=balance and wherein the preheating or the end of the hot rough preliminary processing preceding the final hot rolling brings the products to a temperature betwen 1000° C. and 1160°, and wherein the final hot rolling which is effected at a temperature below or equal to 1150° C. produces a section reduction "S/s" which is at least equal to 3, and which reduction is followed by homogenous cooling.

2. The process of claim 1, wherein the manufactured steel contains: Cr=11.0 to 14.0%.

3. The process of claim 1 or 2, wherein the manufactured steel contains: C=0.030 to 0.060% and N=0.020 to 0.050% with C+N≦0.100%.

4. The process of claim 1 or 2, wherein the preheating or the end of the hot rough preliminary processing preceding the hot final rolling brings the product to a temperature between 1050° C. and 1160° C.

5. The process of claim 1, wherein the final hot rolling is terminated at a temperature of the final product between 1050° and 950° C.

6. Rod or machine wire of martensitic stainless steel, comprising by weight %:

C=0.015 to 0.90
N=0.015 to 0.080 with C+N=0.05 to 0.120
Cr=9.0 to 14.0
Nb=≦0.1
V=≦0.1
S=≦0.35
Si=≦1.0
Mn=≦1.0
Ni=≦2.0
Mo=≦1.0
P=≦0.040
Cu=≦1.0
Fe and impurities=balance and having the following mechanical properties:

R=900 to 1100 MPa; E 0.2=650 to 850 MPa; A≧10%; and resilience KCU≧40 J/cm$^2$.

7. The rod or machine wire of claim 6, wherein it contains:

C=0.030 to 0.060% and N=0.020 to 0.050% with C+N≦0.100%.

8. The rod or machine wire of claim 6 or 7, wherein S≦0.08% and wherein it has the following mechanical properties:

R=900 to 1100 MPa; E 0.2=650 to 850 MPa; A=12 to 16%; resilience KCU=80 to 140 J/cm$^2$.

9. The machine wire of claim 6, of between 5 to 35 mm diameter or thickness, in trimmed rods or in rings.

10. The rod as of claim 6, of between 15 and 250 mm diameter or thickness.

* * * * *